US011091868B2

(12) United States Patent
Song et al.

(10) Patent No.: US 11,091,868 B2
(45) Date of Patent: Aug. 17, 2021

(54) WASHING MACHINE

(71) Applicants: CHONGQING HAIER DRUM WASHING MACHINE CO., LTD., Chongqing (CN); HAIER SMART HOME CO., LTD., Shandong (CN)

(72) Inventors: Huacheng Song, Shandong (CN); Sheng Xu, Shandong (CN); Yanfen Lv, Shandong (CN)

(73) Assignees: CHONGQING HAIER DRUM WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 81 days.

(21) Appl. No.: 16/466,437

(22) PCT Filed: Dec. 7, 2017

(86) PCT No.: PCT/CN2017/114982
§ 371 (c)(1),
(2) Date: Jun. 4, 2019

(87) PCT Pub. No.: WO2018/103690
PCT Pub. Date: Jun. 14, 2018

(65) Prior Publication Data

US 2019/0309461 A1 Oct. 10, 2019

(30) Foreign Application Priority Data

Dec. 8, 2016 (CN) ..... 201611121227.7

(51) Int. Cl.
*D06F 37/06* (2006.01)
*D06F 37/14* (2006.01)
(Continued)

(52) U.S. Cl.
CPC ..... *D06F 37/06* (2013.01); *D06F 37/02* (2013.01); *D06F 37/14* (2013.01); *D06F 37/261* (2013.01); *D06F 23/04* (2013.01)

(58) Field of Classification Search
CPC ..... D06F 37/02; D06F 37/04; D06F 37/06; D06F 37/12
See application file for complete search history.

(56) References Cited

U.S. PATENT DOCUMENTS 9,574,296 B2 2/2017 Kim
2006/0179897 A1 8/2006 Saito et al.
(Continued)

FOREIGN PATENT DOCUMENTS

CN 102268800 A 12/2011
CN 102733147 A 10/2012
(Continued)

OTHER PUBLICATIONS

CN205711422U Machine Translation (Year: 2016).*
(Continued)

*Primary Examiner* — Spencer E. Bell
(74) *Attorney, Agent, or Firm* — Buchanan Ingersoll & Rooney PC

(57) ABSTRACT

A washing machine comprises an inner drum, wherein a drum bottom of the inner drum is installed with an inner drum bottom cover, and the inner drum bottom cover is in sealed connection with the drum bottom of the inner drum to form a sealed space. Such a setting avoids problems of breeding of bacteria and generation of smudge caused when washing water enters the inner drum bottom cover and is deposited in a chamber formed between the inner drum bottom cover and the drum bottom of the inner drum in a process of washing clothes by a washing machine.

9 Claims, 6 Drawing Sheets

(51) Int. Cl.

| | |
|---|---|
| ***D06F 37/26*** | (2006.01) |
| ***D06F 37/02*** | (2006.01) |
| ***D06F 23/04*** | (2006.01) |

(56) References Cited

U.S. PATENT DOCUMENTS

| | | | | |
|---|---|---|---|---|
| 2014/0202217 | A1 | 7/2014 | Hong et al. | |
| 2014/0202218 | A1* | 7/2014 | Hong | D06F 58/08 68/140 |
| 2015/0096333 | A1 | 4/2015 | Shu et al. | |

FOREIGN PATENT DOCUMENTS

| | | | |
|---|---|---|---|
| CN | 103154351 | A | 6/2013 |
| CN | 204298639 | U | 4/2015 |
| CN | 104727077 | A | 6/2015 |
| CN | 205347800 | U | 6/2016 |
| CN | 105887425 | A | 8/2016 |
| CN | 205711422 | U | 11/2016 |
| CN | 107201627 | A | 9/2017 |
| FR | 1352933 | A | 2/1964 |
| JP | H10272297 | A | 10/1998 |
| JP | 5025628 | B2 | 9/2012 |
| KR | 19980046029 | U | 9/1998 |
| WO | 2017/057981 | A1 | 4/2017 |

OTHER PUBLICATIONS

International Search Report (PCT/ISA/210) dated Mar. 6, 2018, by the Chinese Patent Office as the International Searching Authority for International Application No. PCT/CN2017/114982.

Search Report dated Dec. 8, 2016, issued by the Chinese Patent Office in the corresponding Chinese Patent Application No. 2016111212277. (3 pages).

Extended European Search Report dated Oct. 21, 2019, issued by the European Patent Office in corresponding European Application No. 17877571.4. (8 pages).

* cited by examiner

WASHING MACHINE

TECHNICAL FIELD

The present disclosure relates to the field of washing machines, in particular to a washing machine.

BACKGROUND

Internal accessories of a washing machine include a lifting rib and an inner drum bottom cover. The lifting rib is one of the major parts of an inner drum of a washing machine. The main function of the lifting rib when clothes are washed in a washing machine is as follows: on the one hand, the lifting ribs and the clothes generate friction, and the parts of the clothes near the lifting ribs and the relative moving parts rub against each other to produce a squeaking effect; on the one hand, the lifting ribs drive the clothes to rotate together, and the clothes are lifted out of the liquid level and sent to a certain height, and fall into the laundry liquid again due to gravity, and collide with the washing liquid to produce a sticking and falling effect, thereby achieving a washing effect. A lifting rib is installed on an inner drum via a screw. In a washing process, washing water will enter into an inner space through a gap between the lifting rib and the inner drum, and the washing water is deposited inside for a long time, thereby breeding bacteria and generating smudge.

The inner drum penetrates through a stainless drum body and a threaded hole of a tripod and is fixed on a flange plate of a motor shaft via a bolt. In order to prevent washing water from entering a screw hole in large quantities, an inner drum bottom cover is arranged on an installation hole in the center of the inner drum. Similar to the lifting rib, washing water will enter to the chamber formed between the inner drum bottom cover and the drum bottom of the inner drum during washing. On the other hand, the existing manners for cleaning an inner drum include current scouring, washing with a hairbrush, and using cleaning particles, etc. However, since the structural space of the inner drum bottom cover and the lifting rib of the inner drum is narrow, washing objectives cannot be achieved through the above inner drum cleaning methods, and washing water entering the inner drum bottom cover may not be discharged, then smudge is generated after long-time accumulation.

In view of this, the present disclosure is hereby proposed.

SUMMARY

The technical problem to be solved in the present disclosure is to overcome shortcomings of the prior art and provide a washing machine. In the washing machine, at least an inner drum bottom cover is in sealed connection with a drum bottom of an inner drum. The space between the inner drum bottom cover and the drum bottom of the inner drum is isolated from the internal space of the inner drum, thereby avoiding the problems of breeding of bacteria and generation of smudge caused by long-time deposition of washing water in a chamber formed between the inner drum bottom cover and the drum bottom of an inner drum.

In order to solve the above technical problem, basic ideas of the technical solution adopted in the present disclosure are as follows:

A washing machine includes an inner drum, an inner drum bottom cover is installed on a drum bottom of the inner drum, and the inner drum bottom cover is in sealed connection with the drum bottom of the inner drum to form a sealed space.

In the above solution, after washing water enters into the inner drum bottom cover, the washing water is difficult to remove, and will be deposited for a long time inside the inner drum bottom cover, thereby causing such problems of breeding bacteria and generating smudge. In the present disclosure, the inner drum bottom cover is directly in sealed connection with the drum bottom of the inner drum to form a sealed chamber, thereby fundamentally preventing the washing water from entering a chamber formed between the inner drum bottom cover and the drum bottom of the inner drum.

Preferably, the drum bottom of the inner drum is fixed on a tripod via a bolt, a sealed chamber is formed by the inner drum bottom cover and the drum bottom of the inner drum, and the bolt is arranged inside the sealed chamber.

In the above solution, the drum bottom of the inner drum is fixed on a tripod via a bolt or is fixed on a flange plate after penetrating through a bolt hole on the tripod. The inner drum bottom cover of the washing machine is fixed on the drum bottom of the inner drum via a screw to cover the bolt on the drum bottom of the inner drum, and a chamber is formed between the inner drum bottom cover and the drum bottom of the inner drum. During washing, after waste water enters to the chamber, the waste water cannot be discharged, and bacteria are easily bred after long-time accumulation of waste water, then when clothes are washed for the next time, clothes are easily polluted. In view of this, in the present disclosure, the inner drum bottom cover and the drum bottom of the inner drum are in sealed connection, thereby preventing the waste water from entering the chamber.

Preferably, the center of the drum bottom of the inner drum is sunken inwards to form a groove, a bolt hole is formed at the bottom of the groove, and a sealed chamber for accommodating a bolt are formed by the inner drum bottom cover and the groove.

Preferably, the center of the inner drum bottom cover is provided with a screw hole, so as to be fixed on the drum bottom of the inner drum via a screw, the outer circumference of the inner drum bottom cover is in sealed connection with the drum bottom of the inner drum, and the outer circumference of the screw hole of the inner drum bottom cover is in sealed connection with the drum bottom of the inner drum.

In the above solution, two gaps exist between the inner drum bottom cover and the drum bottom of the inner drum, namely, a gap at a circumference of the inner drum bottom cover and a gap at the screw hole in the center of the inner drum bottom cover, therefore, in order to connect the inner drum bottom cover with the drum cover of the inner drum in a sealed manner, the two parts need to be sealed.

Preferably, the inner drum bottom cover is concentrically provided with multiple circular convex ribs which extend towards the drum bottom of the inner drum, an outmost circular convex rib is in sealed connection with the drum bottom of the inner drum, and the circular convex ribs around the screw hole is in sealed connection with the drum bottom of the inner drum.

In the above solution, multiple circular convex ribs may be arranged on the periphery of a screw hole. In the present application, preferably, the circular convex rib which is closest to the periphery of the screw hole is in sealed connection with the drum bottom of the inner drum to realize sealing. Of course, in the present disclosure, sealing of the inner drum bottom cover is not limited to sealing via a circular convex rib, and other structures which can realize sealing are also applicable herein.

Preferably, each circular convex rib is arranged concentrically with the screw hole, an end face of an outmost circular convex rib is in sealed connection with the drum bottom of the inner drum, and the end part of the innermost circular convex rib is in sealed connection with the drum bottom of the inner drum.

In the above solution, the outmost circular convex rib is preferably arranged on an outer circumference of the inner drum bottom cover, and this is an optimal waterproof structure.

Preferably, an end face of the outmost circular convex rib is compacted with the drum bottom of the inner drum via a seal ring for sealed connection, the center of the drum bottom of the inner drum is provided with a screw base for assembling a screw, and the inner surface of an end part of the innermost circular convex rib is compacted with an outer wall of the screw base via a seal ring for sealed connection.

Preferably, the end face of the outmost circular convex rib and the inner surface of an end part of the innermost circular convex rib are respectively provided with a groove, and the seal ring is accommodated in the groove and extends out of the groove to be in sealed contact with a surface of the inner drum;

further preferably, the end face of the outmost circular convex rib and the inner surface of an end part of a innermost circular convex rib are respectively provided with the groove on at least one circle, and each ring of grooves are correspondingly set with a seal ring; and more preferably, multiple rings of grooves are arranged respectively on the end face of the outmost circular convex rib and the inner surface of an end part of a innermost circular convex rib, and multiple rings of grooves correspond to one seal ring. One side of the seal ring is provided with protruding parts which respectively correspond to one groove, while another side is in sealed connection with the drum bottom of the inner drum.

In the above solution, multiple grooves correspond to one seal ring, therefore, installation process can be simplified, and initial installation can be finished after directly installing a seal ring in multiple corresponding grooves. Further, the width of the protruding part of the seal ring is slightly greater than the width of a groove, then when the seal ring is installed in the groove, an effect that the seal ring is connected in a groove in an automatically compacted manner is produced, therefore, the connection between the seal ring and the groove is firmer.

Preferably, the washing machine further includes a lifting rib arranged on the drum wall of the inner drum, and the lifting rib is in sealed connection with the drum wall of the inner drum to form a sealed space.

In an existing washing machine, a surface of the lifting rib is generally provided with a through hole which is configured to connect an internal cavity of the lifting rib with a space of the inner drum of a washing machine. Then the internal space of the lifting rib becomes clean under scouring of water inside the inner drum, however, after clothes washing is finished, water in small quantities is often deposited inside the lifting rib, then when the clothes washing process is longer, bacteria will be bred since this portion of water is deposited for a longer time, then clothes washed for the next time are polluted. In the present disclosure, the inner of the lifting rib is directly set to be isolated from the inner space of the inner drum to form a sealed space, thereby avoiding washing water from entering inside the lifting rib. Meanwhile, the inner drum bottom cover is isolated from the internal space of the inner drum in a sealed manner, and an anticipant effect cannot be achieved. In order to achieve the best pollution reduction effect, in the present disclosure, under the premise that the inner drum bottom cover is in sealed connection with the drum bottom of the inner drum, the lifting rib is further set to be in sealed connection with the drum wall of the inner drum, then accessories inside the inner drum are all in sealed connection with the inner drum, thereby basically ensuring that internal environment of the inner drum of a washing machine is clean and not polluted.

Preferably, the lifting rib is provided with an opening end, and the opening end is in sealed connection with the drum wall of the inner drum, preferably, the lifting rib is fixed on the drum wall of the inner drum via a screw and/or a clip connecting piece, and an opening end of the lifting rib is also provided with a groove which accommodates a seal ring, and under the pressure of a screw and/or a clip connecting piece, the seal ring is arranged between the groove and the drum wall of the inner drum in a compressed manner by the lifting rib.

The present disclosure further provides a washing machine. The washing machine includes the inner drum, and a lifting rib is arranged on the drum wall of the inner drum, wherein the lifting rib is in sealed connection with the drum wall of the inner drum to form a sealed space; or the lifting rib and the drum wall of the inner drum are molded in one body and are of a solid structure; and preferably, the lifting rib is provided with an opening end, and the opening end is in sealed connection with the drum wall of the inner drum. Preferably, the lifting rib is fixed on the drum wall of the inner drum via a screw and/or a clip connecting piece, and an opening end of the lifting rib is also provided with a groove which accommodates a seal ring, and under the pressure of a screw and/or a clip connecting piece, the seal ring is arranged between the groove and the drum wall of the inner drum in a compressed manner by the lifting rib.

After the above technical solution is adopted, the present disclosure has the following beneficial effects compared with the prior art:

1. For the washing machine in the present disclosure, a sealing treatment is performed on internal accessories which contact with water, then washing water is excluded outside, thereby avoiding long-time deposition of washing water inside the washing machine, and breeding of bacteria and generation of smudge are avoided. Wherein, further, accessories of the present disclosure mainly include a lifting rib arranged on the drum wall of the inner drum and the inner drum bottom cover installed on the drum bottom of the inner drum, and these two parts are the parts that washing water easily enters, and are key parts to prevent dirt and smudge for washing water. The present disclosure provides technical solution to respectively seal the inner drum bottom cover and the lifting rib, thereby solving the problem that clothes washed for the next time are polluted when washing water enters the inner drum bottom cover and the lifting rib and is stored for a long time.

2. The present disclosure aims at providing a washing machine which prevents waste water during clothes washing from depositing in accessories of the inner drum, so an anticipant effect cannot be achieved only by isolating the lifting rib or the inner drum bottom cover from the inner space of the inner drum, therefore, in the present disclosure, preferably, the lifting rib and the inner drum bottom cover are both set to be isolated from the inner space of the inner drum, thereby basically ensuring that internal environment of a washing machine is clean and not polluted.

A brief description will be further given below on specific embodiments of the present disclosure in combination with accompanying drawings.

BRIEF DESCRIPTION OF THE DRAWINGS

As a part of the present application, the drawings are used for providing further understanding of the present disclosure, and illustrative embodiments and descriptions thereof of the present disclosure are used for explaining the present disclosure, rather than constituting an improper limitation to the present disclosure. Apparently, the drawings described below are merely some embodiments, and for those skilled in the art, other drawings can be obtained according to these drawings without paying any creative effort. In the drawings.

Figure 1:
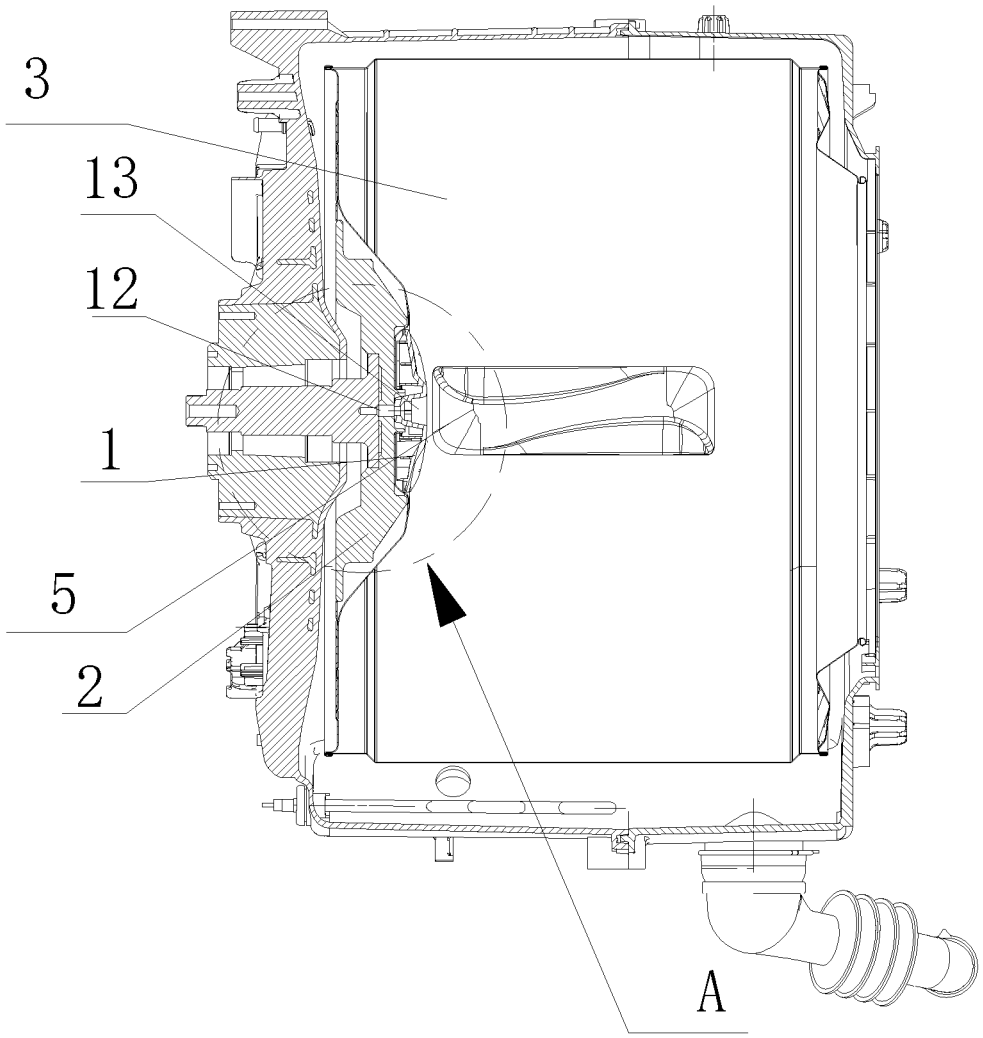
FIG. 1 is a sectional view of a washing machine of the present disclosure.
Figure 2:
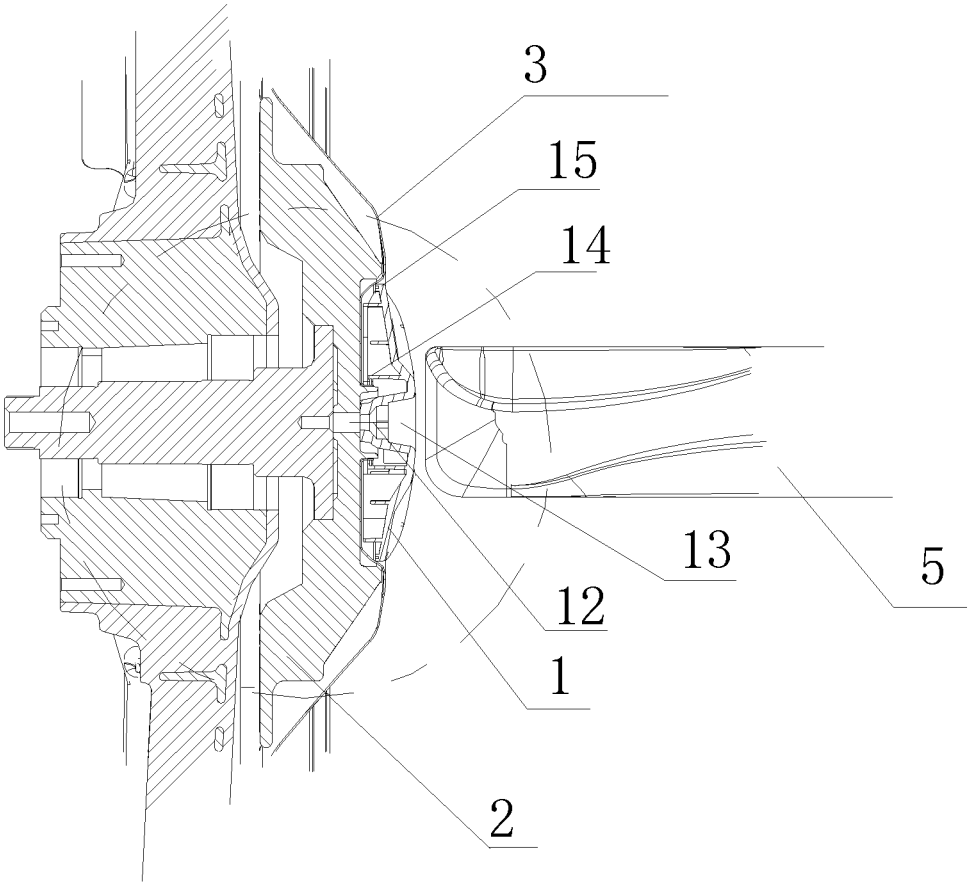
FIG. 2 is an enlarged view of part A in FIG. 1.
Figure 3:
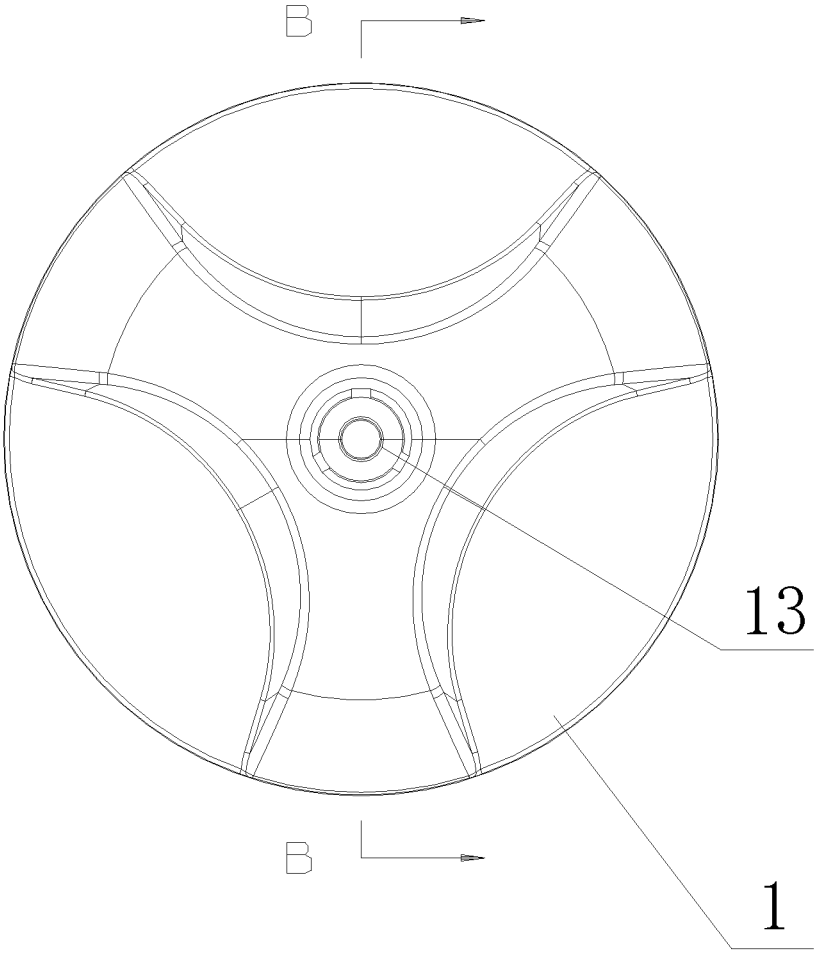
FIG. 3 is a structural schematic diagram of a front-side structure of the inner drum bottom cover.
Figure 4:
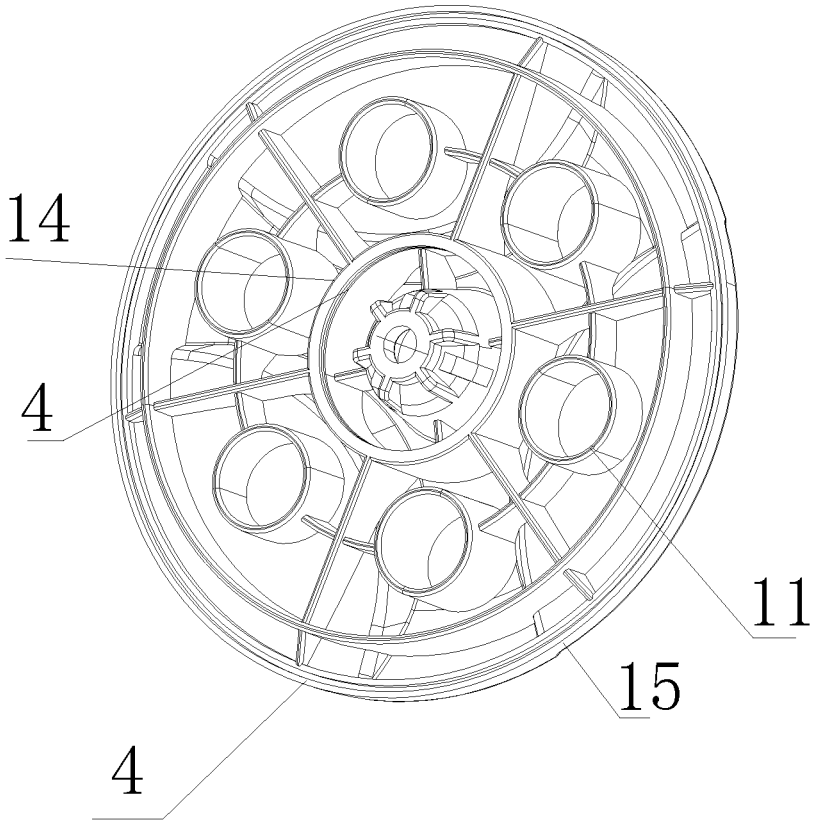
FIG. 4 is a structural schematic diagram of a bottom surface of the inner drum bottom cover.
Figure 5:
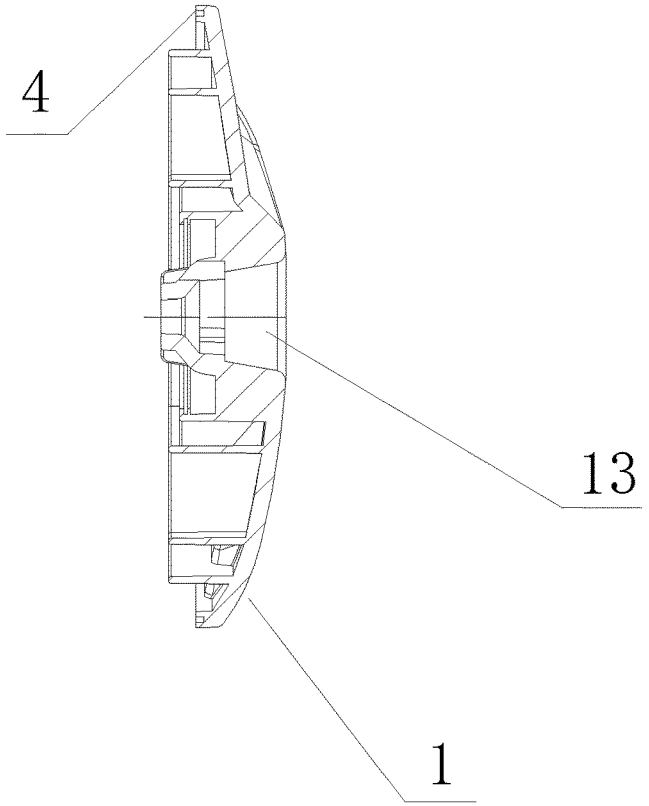
FIG. 5 is a sectional view of B-B of FIG. 3.

Reference numerals in the figures: 1, inner drum bottom cover; 11, accommodation chamber; 12, screw; 13, screw hole; 14, innermost circular convex rib; 15, outmost circular convex rib; 2, tripod; 3, inner drum; 4, groove; 5, lifting rib; 6, clip connecting piece; 7, lifting rib screw base.

It should be noted that, these drawings and text descriptions are not intended to limit in any form the conception scope of the present disclosure, but to illustrate concepts of the present disclosure for those skilled in the art with reference to specific embodiments.

DETAILED DESCRIPTION

In order that objectives, technical solutions and advantages of the embodiments of the present disclosure are clearer, a clear and complete description will be given below on technical solutions in the embodiments in combination with drawings in embodiments of the present disclosure. The following embodiments are merely used for explaining the present disclosure, rather than for limiting the scope of the present disclosure.

In the description of the present disclosure, it should be noted that, the directional or positional relationship indicated by such terms as "upper", "lower", "inner" and "outer" is the directional or positional relationship shown based on the drawings, which is merely for convenient and simplified description of the present disclosure, rather than indicating or implying that the referred device or element must have the specific direction or must be constructed and operated in the specific direction, therefore, it cannot be understood as a limitation to the present disclosure.

In the description of the present disclosure, it should be noted that, unless otherwise definitely prescribed and defined, the terms "installation", and "connection" should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium. The specific meaning of the above-mentioned terms in the present disclosure may be understood by those of ordinary skill in the art in light of specific circumstances.

Embodiment 1

Refer to FIG. 1 to FIG. 5. The present embodiment provides a drum washing machine which includes an inner drum 3, wherein an inner drum bottom cover 1 is installed on the drum bottom of the inner drum 3, and the inner drum bottom cover 1 is in sealed connection with a surface of the inner drum to form a sealed space.

In the prior art, in a washing process, washing water is difficult to remove after entering a chamber formed between the inner drum bottom cover 1 and the drum bottom of the inner drum. The existing manners for cleaning the inner drum include current scouring, washing with a hairbrush, and using cleaning particles, etc. However, since the structural space in this part is narrow, washing objectives cannot be achieved through the above inner drum cleaning methods. Then in a clothes washing process, washing water will be deposited under the inner drum bottom cover for a long time, thereby causing such problems of breeding of bacteria and generation of smudge. In the present disclosure, the inner drum bottom cover and the drum bottom of the inner drum are directly connected in a sealed manner to form a sealed chamber, thereby fundamentally stopping washing water from entering a chamber formed between the inner drum bottom cover and the drum bottom of the inner drum, and solving the problem that clothes washed for the next time are polluted by bacteria bred due to long-time deposition of washing water in the inner drum.

The drum bottom of the inner drum is fixed on a tripod 2 via a bolt or penetrates through a bolt hole on the tripod 2 and is fixed on a flange plate, and the inner drum bottom cover 1 of a washing machine is fixed on the drum bottom of the inner drum via a screw 12 to cover a bolt on the drum bottom of the inner drum, and forms a chamber with the drum bottom of the inner drum. During a clothes washing process, waste water cannot be discharged after entering the chamber, and bacteria are easily bred after long-time accumulation of waste water. Then when clothes are washed for the next time, clothes are easily polluted. In view of this, in the present embodiment, the inner drum bottom cover is in sealed connection with the drum bottom of the inner drum, thereby stopping waste water from entering the inner drum. Specifically, the center of the drum bottom of the inner drum 3 is sunken inwards to form a groove, a bolt hole is formed at the bottom of the groove, and a sealed chamber for accommodating a bolt are formed by the inner drum bottom cover 1 and the groove in a sealed manner.

Specifically, the drum bottom of the inner drum is fixed on the tripod 2 by six bolts which are arranged circularly or penetrates through the bolt hole on the tripod 2 via bolts and is fixed on a flange plate. One side, facing towards the drum bottom of the inner drum, of the inner drum bottom cover 1 is provided with, corresponding to each bolt, an accommodation chamber 11 which is used for accommodating and evading screws. The accommodation chamber 11 covers the bolt, and the end face of the accommodation chamber is also in sealed connection with the drum bottom of the inner drum, thereby preventing washing water from entering the inner space via the bolt.

Embodiment 2

Refer to FIG. 1 to FIG. 5, in the present embodiment, the inner drum bottom cover 1 of a washing machine is of a disc structure, buckled on the drum bottom of the inner drum, and is fixed on the drum bottom of the inner drum via screw 12. Since the inner drum bottom cover 1 is fixed on the drum bottom of the inner drum via a screw, washing water may also enter a chamber formed between the inner drum bottom cover 1 and the drum bottom of the inner drum along a screw 12, therefore, in the present embodiment, two parts of the inner drum bottom cover need to be sealed. The first sealing part is an outer circumference of the inner drum bottom cover 1, and the second sealing part is at the screw hole in the center of the inner drum bottom cover. Wherein, preferably, the circumference surface of the inner drum bottom cover and the screw hole are both in sealed connection with the drum bottom of the inner drum via a sealing element. Further, the sealing element is a seal ring, the inner drum bottom cover 1 is in sealed connection with the drum bottom of the inner drum via a seal ring to realize sealing. Wherein for the screw hole of the second sealing part, sealing treatment can be performed between the screw and the screw hole, and can also be performed through setting a sealed structure around a screw hole. Preferably, in the present disclosure, the sealed effect is better when sealed connection is realized through sealing between a screw and a screw hole as well as sealing through setting a sealed structure around the screw hole.

Specifically, the center of the inner drum bottom cover 1 is provided with a screw hole 13, and the inner drum bottom cover is fixed on the drum bottom of the inner drum by screws through the screw hole. The inner drum bottom cover 1 is concentrically provided with multiple circular convex ribs extending into the drum bottom of the inner drum. The outmost circular convex rib 15 is in sealed connection with the drum bottom of the inner drum, and the circular convex ribs on the periphery of the screw hole is in sealed connection with the drum bottom of the inner drum. The periphery of the screw hole may be provided with multiple circular convex ribs, and in the present embodiment, preferably, the circular convex rib which is closest to the periphery of the screw hole is in sealed connection with the drum bottom of the inner drum to realize sealing. Of course, in the present embodiment, sealing of the inner drum bottom cover is not limited to sealing via a circular convex rib, and other structures which can realize sealing are also applicable herein.

Preferably, each circular convex rib is concentrically set with the screw hole, the end face of the outmost circular convex rib 15 is in sealed connection with the drum bottom of the inner drum, and the end part of a innermost circular convex rib 14 is in sealed connection with the drum bottom of the inner drum. Wherein the outmost circular convex rib 15 is preferably set on an outer circumference of the inner drum bottom cover, and this structure is an optimal waterproof structure.

Further, an end face of the outmost circular convex rib 15 is compacted with the drum bottom of the inner drum 3 via a seal ring for sealed connection, the center of the drum bottom of the inner drum is provided with a screw base for assembling a screw 12, and the inner surface of an end part of the innermost circular convex rib 14 is compacted with an outer wall of the screw base via a seal ring for sealed connection.

Embodiment 3

Please refer to FIG. 1 to FIG. 5. In the present embodiment, the inner drum bottom cover 1 of a washing machine in the present embodiment is provided with a structure which is used for fixing a seal ring. Specifically, a groove 4 is respectively arranged on an end face of a outmost circular convex rib 15 and on the inner surface of an end part of a innermost circular convex rib 14, and the seal ring is accommodated in the groove 4 and extends out of the groove to be in sealed contact with a surface of the inner drum; and further preferably, at least one ring of grooves are arranged respectively on the end face of the outmost circular convex rib 15 and the inner surface of an end part of a innermost circular convex rib 14, and each ring of grooves are correspondingly set with a seal ring;

In order to further improve sealed effect of a seal ring, the seal ring in the present disclosure can be subjected to diversity design, and the grooves 4 can also be diversified accordingly. More preferably, multiple rings of grooves are respectively arranged on the end face of the outmost circular convex rib 15 and the inner surface of an end part of the innermost circular convex rib 14, and multiple rings of grooves correspond to one seal ring. One side of the seal ring is provided with protruding parts which respectively correspond to each groove, and the other side is in sealed connection with the drum bottom of the inner drum. Multiple grooves correspond to one seal ring, therefore, installation process can be simplified, and initial installation can be finished after directly installing the seal ring in multiple corresponding grooves. Further, the width of the protruding part of the seal ring is slightly greater than the width of a groove, then when a seal ring is installed in a groove, an effect that the seal ring is connected in a groove in an automatically compacted manner is produced, therefore, the connection between the seal ring and the groove is firmer.

Embodiment 4

Figure 6:
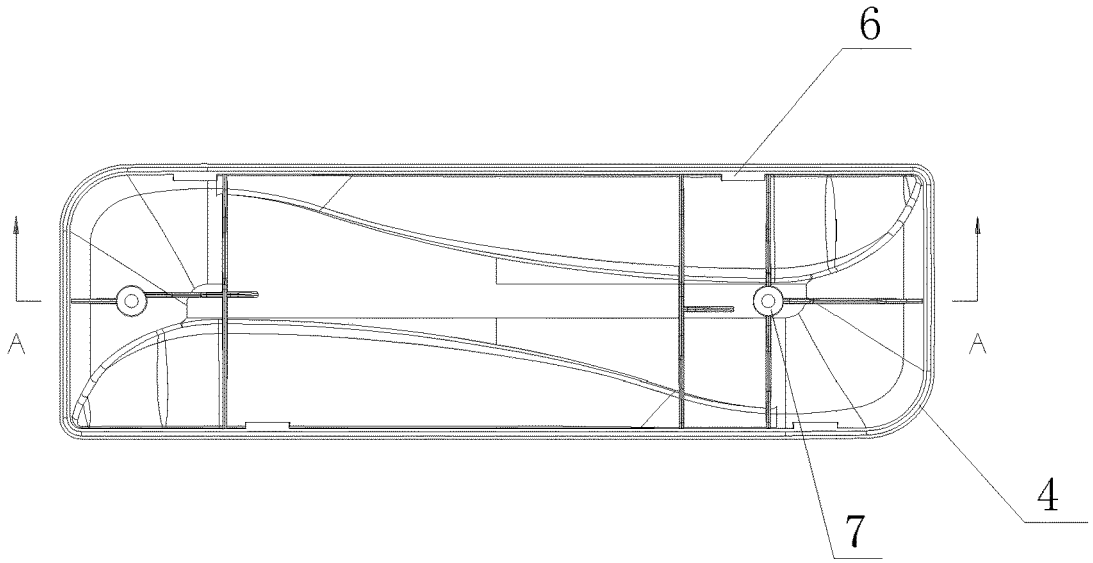
FIG. 6 is a structural schematic diagram of a lifting rib.
Figure 7:
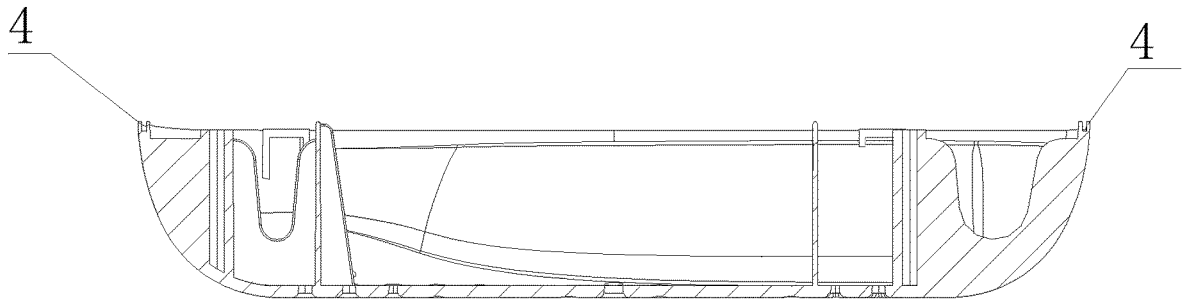
FIG. 7 is a sectional view of A-A of FIG. 6.
Figure 8:
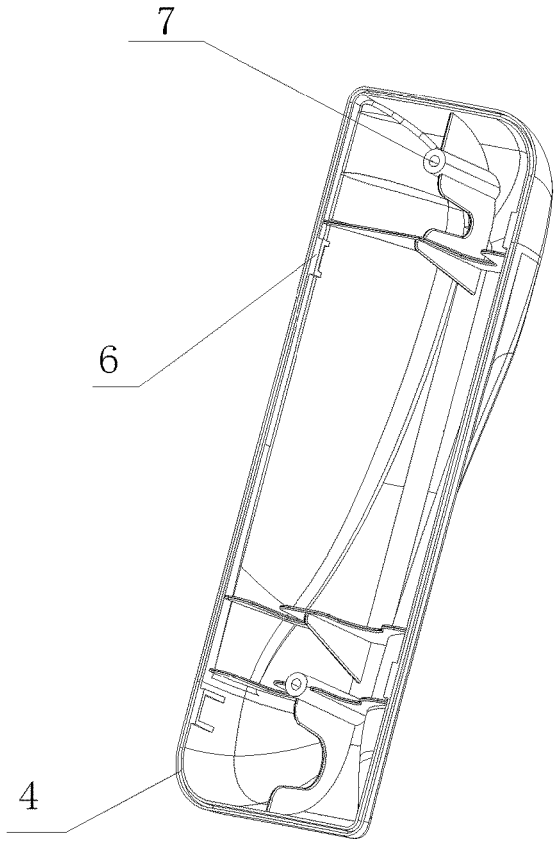
FIG. 8 is a three-dimensional structural schematic diagram of a lifting rib.

Please refer to FIG. 6 to FIG. 8. In the present embodiment, the lifting rib of a washing machine is set to be a structure which is isolated from inner space of the inner drum in a sealed manner. The lifting rib 5 is a shell with an opening, the surface of the shell is not provided with a through hole, the opening end of the shell is in sealed connection with the drum wall of the inner drum. The opening end is provided with a groove 4, the groove 4 accommodates a seal ring, and the seal ring is accommodated in the groove 4 and extends out of the groove to be in sealed contact with the surface of the inner drum.

Further, the lifting rib 5 is fixed on the drum bottom of the inner drum via a screw and/or a clip connecting piece, and under the pressure of the screw and/or clip connecting piece, the seal ring is arranged between the groove and the drum wall of the inner drum in a compressed manner by the lifting rib 5. Specifically, the lifting rib 5 is provided with an installation chamber, clip connecting pieces 6 are arranged around the installation chamber, and clip seats are correspondingly arranged on the drum wall of the inner drum of a washing machine, so as to perform clamping positioning on the lifting rib 5.

Further, the installation chamber is also provided with a lifting rib screw base 7 which extends towards the drum bottom of the inner drum of a washing machine, and the inner drum bottom cover is fixed on the drum wall of the inner drum of a washing machine by screws through the screw hole. Of course, an opening end of a shell of a lifting rib 5 can be provided with a ring of grooves 4 which are matched with the seal ring, the groove 4 is internally provided with a seal ring, and the seal ring protrudes out of the groove to be compressed between the groove and the inner drum of a washing machine. Further, the opening end of a shell of a lifting rib can be provided with multiple rings of grooves which are arranged in parallel, wherein each groove respectively corresponds to one seal ring or all the grooves commonly correspond to one seal ring, and when all the grooves commonly correspond to one seal ring, the structure of the seal ring is slightly complex, with one side of the seal ring being provided with protruding parts which are respectively accommodated in each groove, while the other side being in sealed contact with the drum wall of the inner drum. As a preferable technical solution, in the present embodiment, an opening end of a shell of the lifting rib is provided with two rings of grooves, the seal ring includes two protruding parts which are respectively accommodated within the groove and a connecting part which is configured to connect the protruding parts, and the connecting part is configured between the opening end of a shell of a lifting rib and the drum wall of the inner drum in a compressed manner, thereby preventing water inside the inner drum of a washing machine from entering inside the shell of a lifting rib, since long-time accumulation of waste water inside the lifting rib may breed bacteria and harm health.

Of course, in order that no waste water during clothes washing is accumulated inside a lifting rib, the lifting rib 5 of the inner drum of a washing machine in the present embodiment can be set to be integrated with the inner drum, for example, the lifting rib 5 of a washing machine is formed through stamping from the drum wall to a central axis of the inner drum, then the lifting rib inside a washing machine is not provided with a chamber for accommodating laundry waste water, thereby achieving the purpose of zero pollution during second clothes washing of the lifting rib.

As a further optimization, the lifting rib in the present embodiment can also be set to be a solid structure, then an accommodation chamber which accommodates laundry waste water is not provided, thereby avoiding long-time deposition of washing water inside the lifting rib, and breeding of bacteria and generation of smudge are avoided.

In the above solution, the lifting rib is arranged to be a solid structure, then the weight of the inner drum is increased, and materials with low density and high hardness need to be selected. Therefore, in order to lower difficulty, in the present embodiment, the lifting rib can be set to be a sealed hollow structure, then the weight of the lifting rib can be reduced, and long-time deposition of washing water in the lifting rib can be avoided, thereby avoiding breeding bacteria and generating smudge.

Embodiment 5

An anticipant effect cannot be achieved only by isolating the lifting rib 5 or the inner drum bottom cover 1 from the inner space of the inner drum in a sealed manner. In order to achieve the best anti-pollution effect, the present embodiment differs from the above embodiments as follows: in the present embodiment, all the internal accessories of the inner drum are set to be structures which are isolated from the inner space of the inner drum in a sealed manner, wherein accessories of the inner drum mainly include a lifting rib 5 and the inner drum bottom cover 1. In the present embodiment, the inner drum bottom cover adopts the technical solution in embodiment 1, embodiment 2 or embodiment 3 or adopts the technical solution of any combination of the above three embodiments, while a lifting rib of the inner drum in the present embodiment adopts the technical solution in embodiment 4. In the present embodiment, the lifting rib and the inner drum bottom cover are simultaneously set to be a structure sealed with the inner drum, thereby basically ensuring that internal environment of the inner drum of a washing machine is clean and no pollution is generated.

It should be noted that, the technical solutions defined by the above embodiments of the present disclosure can be implemented separately, and can also be combined with each other for implementation. The technical solution defined by the above embodiments of the present disclosure can be applicable to drum washing machines, and can also be applicable to pulsator washing machines.

The above descriptions are merely preferred embodiments of the present disclosure, rather than a limitation to the present disclosure in any form. Although the present disclosure is disclosed above through the preferred embodiments, however, the present disclosure is not limited hereto. Those skilled in the art can make some changes or modify to equivalent embodiments with equivalent changes by utilizing the technical contents enlightened above under the premise of not departing from the scope of the technical solution of the present disclosure. As long as the contents do not depart from the technical solution of the present disclosure, any simple alterations, equivalent changes and modifications made to the above embodiments according to the technical essence of the present disclosure shall still fall within the scope of the solution of the present disclosure.

The invention claimed is:

1. A washing machine, comprising an inner drum, and an inner drum bottom cover installed on a drum bottom of the inner drum, wherein the inner drum bottom cover is in sealed connection with the drum bottom of the inner drum to form a sealed chamber;

the inner drum bottom cover is concentrically provided with multiple circular convex ribs extending towards the drum bottom of the inner drum, an end face of an outermost circular convex rib is compacted with the drum bottom of the inner drum via a first seal ring for sealed connection, a center of the drum bottom of the inner drum is provided with a screw base for installing a screw, and an inner surface of an end part of an innermost circular convex rib is compacted with an outer wall of the screw base via a second seal ring for sealed connection.

2. The washing machine according to claim 1, wherein the drum bottom of the inner drum is fixed on a tripod via a bolt, and the bolt is arranged inside the sealed chamber.

3. The washing machine according to claim 2, wherein the center of the drum bottom of the inner drum is provided with a groove, a bolt hole is formed at a bottom of the groove, and the sealed chamber for accommodating the bolt is formed by the inner drum bottom cover and the groove.

4. The washing machine according to claim 1, wherein a first groove is arranged on the end face of the outermost circular convex rib, a second groove is arranged on the inner surface of the end part of the innermost circular convex rib; and the first seal ring is accommodated in the first groove and extends out of the first groove to be in sealed contact with the drum bottom of the inner drum; the second seal ring is accommodated in the second groove and extends out of the second groove to be in sealed contact with the outer wall of the screw base.

5. The washing machine according to claim 4, wherein the end face of the outermost circular convex rib is provided with a plurality of first grooves, the inner surface of the end part of the innermost circular convex rib is provided with a plurality of second grooves; and each first groove is provided with the first seal ring, each second groove is provided with the second seal ring.

6. The washing machine according to claim 4, wherein the end face of the outermost circular convex rib is provided with a plurality of first grooves, the inner surface of the end part of the innermost circular convex rib is provided with a plurality of second grooves;

one side of the first seal ring is provided with a plurality of first protruding parts, each first groove corresponds to one of the first protruding parts, another side of the first seal ring is in sealed connection with the drum bottom of the inner drum; and one side of the second seal ring is provided with a plurality of second protruding parts, each second groove corresponds to one of the second protruding parts, another side of the seal ring is in sealed connection with the outer wall of the screw base.

7. The washing machine according to claim 1, further comprising a lifting rib arranged on a wall of the inner drum, wherein the lifting rib is in sealed connection with the wall of the inner drum to form a sealed space.

8. The washing machine according to claim 7, wherein the lifting rib is provided with an opening end, and the opening end is in sealed connection with the wall of the inner drum.

9. The washing machine according to claim 8, wherein the lifting rib is fixed on the wall of the inner drum by a screw and/or a clip connecting piece, the opening end of the lifting rib is provided with a groove for accommodating a seal ring, and the seal ring is compressed between the groove of the lifting rib and the wall of the inner drum under the pressure of the screw and/or the clip connecting piece.

* * * * *